US005305061A

United States Patent [19]

Takama et al.

[11] Patent Number: 5,305,061

[45] Date of Patent: Apr. 19, 1994

[54] IMAGE FORMING APPARATUS HAVING A CONTACT CHARGING DEVICE THAT EXHIBITS UNIFORM CHARGING THROUGH REDUCED RESIDUAL TONER ADHESION

[75] Inventors: Masaaki Takama, Takatsuki; Junji Machida, Toyonaka; Akihito Ikegawa, Sakai, all of Japan

[73] Assignee: Minolta Camera Kabushiki Kaisha, Osaka, Japan

[21] Appl. No.: 808,618

[22] Filed: Dec. 17, 1991

[30] Foreign Application Priority Data

Dec. 21, 1990 [JP] Japan ..... 2-413198
Dec. 21, 1990 [JP] Japan ..... 2-413199
Dec. 21, 1990 [JP] Japan ..... 2-413200

[51] Int. Cl.[5] ..... G03G 15/02; G03G 15/00

[52] U.S. Cl. ..... 355/219; 355/245; 430/111

[58] Field of Search ..... 355/219, 245; 430/110, 430/111; 361/225

[56] References Cited

U.S. PATENT DOCUMENTS 3,819,367 6/1974 Chatterji et al. ..... 96/1 SD
4,455,078 6/1984 Mukai et al. ..... 355/219
4,469,435 9/1984 Nosaki et al. ..... 355/15
4,761,709 8/1988 Ewing et al. ..... 361/225
4,769,676 9/1988 Mukai et al. ..... 355/15
4,987,454 1/1991 Natsuhara et al. ..... 430/111 X

*Primary Examiner*—Joan H. Pendegrass
*Attorney, Agent, or Firm*—Burns, Doane, Swecker & Mathis

[57] ABSTRACT

An image forming apparatus comprises an image carrier for carrying an electrostatic latent image on its surface, a charging member for charging the image carrier to a predetermined polarity by contacting with the surface of the image carrier, latent image forming means for forming an electrostatic latent image corresponding to image information on the surface of the image carrier charged, and a developing device containing toner including toner particles not less than 90% of which have a shape factor SF−1 expressed by the following equation of not more than 160 and less than 1% of which have a shape factor SF−1 of not less than 170 so as to develop the electrostatic latent image formed on the surface of the image carrier into a toner image:

$$[SF-1]=(L^2/S)\times\pi/4\times100$$

(in the equation, S is the area indicating the average value of the projected areas of the toner, and L is the maximum length indicating the average value of the maximum lengths at the time of projecting the toner).

24 Claims, 5 Drawing Sheets

IMAGE FORMING APPARATUS HAVING A CONTACT CHARGING DEVICE THAT EXHIBITS UNIFORM CHARGING THROUGH REDUCED RESIDUAL TONER ADHESION

BACKGROUND OF THE INVENTION

1. Field of the Invention

The present invention relates generally to an image forming apparatus utilizing an electrophotographic technique such as a printer and a copying machine, and more particularly, to an image forming apparatus so adapted to bring a charging brush (which means a brush for carrying out charging) into contact with the surface of an image carrier (which means holding an electrostatic latent image holding member on which an electrostatic latent image is formed) to charge the image carrier to a predetermined polarity, form an electrostatic latent image corresponding to image information on the surface of the image carrier thus charged by latent image forming means, and supply toner to the surface of the image carrier having the electrostatic latent image thus formed thereon from a developing device, to develop the electrostatic latent image thus formed on the surface of the image carrier into a toner image (which means forming a toner image corresponding to the electrostatic latent image).

2. Description of Related Art

Conventionally, an image forming apparatus utilizing an electrophotographic technique such as a printer and a copying machine has been generally so adapted to charge an image carrier by the corona discharge method, form an electrostatic latent image corresponding to image information on the surface of the image carrier thus charged by latent image forming means, and supply toner to the surface of the image carrier having the electrostatic latent image formed thereon, to develop the electrostatic latent image formed on the surface of the image carrier into a toner image.

When the image carrier is charged by the corona discharge method as described above, however, harmful ozone is generated when corona discharging is carried out, and a power supply for outputting a high voltage is required to carry out the corona discharging, resulting in a high manufacturing cost.

In recent years, therefore, a method of charging an image carrier at a low voltage has been examined in addition to the above described corona discharge method for charging an image carrier using a power supply for outputting a high voltage. As a method of charging an image carrier at a low voltage, a method of bringing a charging brush into contact with the surface of an image carrier to charge the image carrier has been developed.

However, the method of bringing a charging brush into contact with the surface of an image carrier to charge the image carrier has not been satisfactorily examined yet. The method has not been generalized in the present circumstances because it has the disadvantages, for example, in that toner remaining on the image carrier is accumulated in the charging brush by adhesion, the image carrier is not uniformly charged, and the image carrier is filmed with the toner thus accumulated in the charging brush by adhesion.

SUMMARY OF THE INVENTION

An object of the present invention is to eliminate, in an image forming apparatus so adapted that a charging brush is brought into contact with the surface of an image carrier to charge the image carrier, the possibilities that toner remaining on the image carrier is accumulated in the charging brush by adhesion, the image carrier is not uniformly charged, and the image carrier is filmed with the toner accumulated in the charging brush by adhesion are eliminated so that the image carrier is stably charged by the charging brush and a good image is stably obtained by the image forming apparatus.

Therefore, the inventors of the present application have analized the causes of the accumulation of the toner remaining on the image carrier in the charging brush by adhesion and the nonuniformity of charging in the image carrier in bringing the charging brush into contact with the surface of the image carrier as described above and investigated the causes so as to find a solution.

As a result, properties such as the brush density of the charging brush used for charging the image carrier and the shape of the toner used in the developing device largely affect the causes, to complete the present invention.

A first image forming apparatus according to the present invention is an image forming apparatus comprising an image carrier for carrying an electrostatic latent image on its surface, a charging brush having a brush density of 50,000 to 200,000 elements/in.$^2$ and brought into contact with the surface of the above image carrier to charge the image carrier to a predetermined polarity, latent image forming means for forming an electrostatic latent image corresponding to image information on the surface of the image carrier charged, and a developing device for developing the electrostatic latent image formed on the surface of the image carrier with toner including toner particles not less than 90% of which have a shape factor SF−1 expressed by the following equation [1] of not more than 160 and less than 1% of which have a shape factor SF−1 of not less than 170:

$$[SF-1]=(L^2/S)\times\pi/4\times 100 \quad [1]$$

(In the equation, S is the area indicating the average value of the projected areas of the toner, and L is the maximum length indicating the average value of the maximum lengths in a projected image of the toner).

A second image forming apparatus according to the present invention is an image forming apparatus comprising an image carrier for carrying an electrostatic latent image on its surface, a charging brush having a brush density of 50,000 to 200,000 elements/in.$^2$ and brought into contact with the surface of the above image carrier to charge the image carrier to a predetermined polarity, latent image forming means for forming an electrostatic latent image corresponding to image information on the surface of the image carrier charged, and a developing device for developing the electrostatic latent image formed on the surface of the image carrier with toner having 0.1 to 5% by weight of a fluidizing agent whose particle diameter is 1/20 to 1/100 of that of its toner particles added thereto.

A third image forming apparatus according to the present invention is an image forming apparatus comprising an image carrier for carrying an electrostatic latent image on its surface, a charging brush having a brush density of 50,000 to 200,000 elements/in.$^2$ and brought into contact with the surface of the above image carrier to charge the image carrier to a predetermined polarity, latent image forming means for forming an electrostatic latent image corresponding to image information on the surface of the image carrier charged, and a developing device for developing the electrostatic latent image formed on the surface of the image carrier with toner having an average volume particle diameter of 3 to 8 μm and including toner particles not less than 70% of which have a particle diameter in the range of $x \pm 4 \log x$ in the volume distribution when the average volume particle diameter of the toner is taken as x μm.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
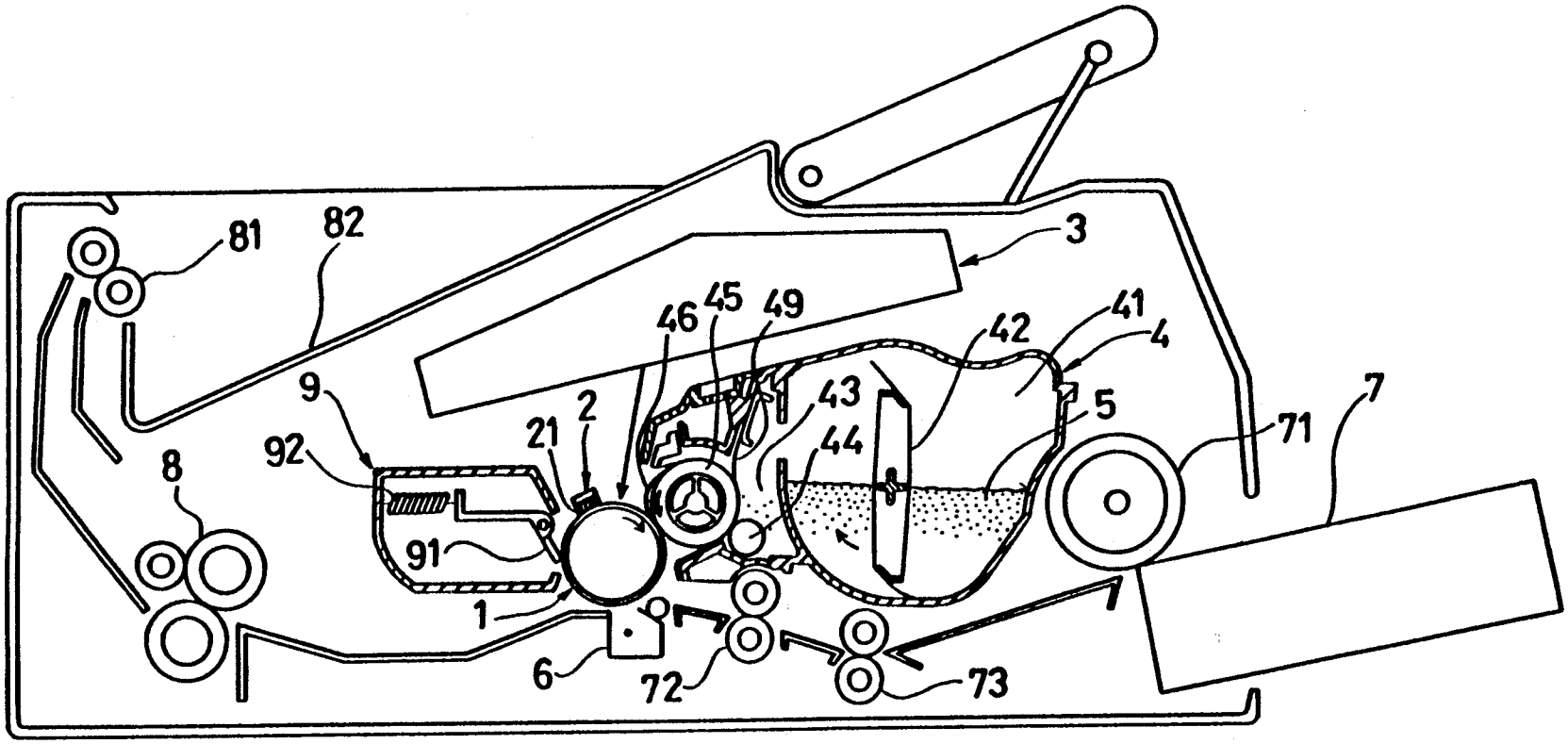
FIG. 1 is a schematic cross sectional view showing one example of an image forming apparatus according to the present invention.

A first image forming apparatus according to the present invention will be described in detail.

The first image forming apparatus comprises an image carrier for carrying an electrostatic latent image on its surface, a charging brush having a brush density of 50,000 to 200,000 elements/ in.$^2$ and brought into contact with the surface of the above image carrier to charge the image carrier to a predetermined polarity, latent image forming means for forming an electrostatic latent image corresponding to image information on the surface of the image carrier charged, and a developing device for developing the electrostatic latent image formed on the surface of the image carrier with toner including toner particles not less than 90% of which have a shape factor SF−1 expressed by the foregoing equation [1] of not more than 160 and less than 1% of which have a shape factor SF−1 of not less than 170.

The reason why the charging brush having a brush density of 50,000 to 200,000 elements/in.$^2$ is used is as follows. More specifically, if a charging brush having a brush density of less than 50,000 elements/in.$^2$ is used, the image carrier is liable to be nonuniformly charged and a high voltage is required to charge the image carrier in charging the image carrier by the charging brush. On the other hand, if a charging brush having a brush density of more than 200,000 elements in.$^2$ is used, the nonuniformity of charging in the image carrier is eliminated but toner is accumulated in the charging brush by adhesion if image formation is repeated and the amount of the accumulation is increased to such an extent that it is not negligible what type of toner is used.

A brush portion of such a charging brush is generally constituted by artificial fibers having a conductive material dispersed therein. It is possible to use as the artificial fibers ones composed of nylon, acrylic, rayon, polycarbonate, polyester or the like. In addition, it is possible to use as the conductive material carbon black, metal powder or the like.

Furthermore, in the above described charging brush, the thickness of the fibers is 1 to 20 deniers, the length of the fibers is 1 to 10 mm, and the resistance value of the fibers is $10^2$ to $10^9 \Omega \cdot$cm, and the width of contact of the fibers with the image carrier in the direction of movement of the image carrier is approximately 2 to 20 mm.

In bringing the charging brush into contact with the surface of the image carrier to charge the image carrier, the fibers of the charging brush are pressed against the surface of the image carrier so that approximately 0.2 to 5 mm the fibers contact the surface of the image carrier. In this state, the above image carrier is moved while applying a DC voltage of ±700 to 1500 V to the charging brush from a power supply so that the surface of the image carrier brought into contact with the charging brush is charged to a predetermined polarity. In addition, when the image carrier is thus charged, it is preferable that the moving speed of the image carrier is 5 to 60 mm/sec relative to the charging brush so as to sufficiently charge the image carrier.

After the image carrier is thus charged by the charging brush, an electrostatic latent image corresponding to image information is formed on the surface of the charged image carrier by the latent image forming means such as an exposure device, and toner is supplied to the surface of the image carrier having the electrostatic latent image thus formed thereon from the developing device, to develop the electrostatic latent image formed on the surface of the image carrier into a toner image by the toner.

Used as the toner supplied to the surface of the image carrier from the developing device is toner consisting of toner particles not less than 90% of which have a shape factor SF−90% of which described above of not more than 160 and less than 1% of which have a shape factor SF−1 of not less than 170. The reason for this is as follows. More specifically, if the toner particles having a shape factor SF−1 of not more than 160 are less than 90% of all the toner, the toner does not easily pass through the charging brush having a brush density of 50,000 to 200,000 elements/in.$^2$ as described above. Accordingly, the toner is accumulated in the charging brush if image formation is repeated. On the other hand, even if the toner particles having a shape factor SF−1 of not more than 160 are not less than 90% of the toner, the toner can hardly pass through the charging brush having the above described brush density if the toner particles having a shape factor SF−1 of not less than 170 are not less than 1% of the toner. Accordingly, unless the content of the toner particles having a shape factor SF−1 of not less than 170 is less than 1%, the toner is accumulated in the charging brush if image formation is repeated, in the same manner as described above.

In the present invention, the above described shape factor SF−1 is measured using an image analyzer (Ruezex 5000 manufactured by Nippon Regulator Co., Ltd.).

The shape of the toner is close to a spherical shape as the shape factor SF−1 approaches 100.

Furthermore, toner used in the present invention may be produced in any method provided that the foregoing conditions are satisfied. For example, it is possible to use toner produced through the processes such as kneading, grinding and classification, toner produced by spraying a solution obtained by dissolving or dispersing a toner component in a solvent or dispersing the solution in a water solvent, toner produced by suspension polymerization, and toner treated so as to have a capsule structure utilizing as a core particles obtained by suspension polymerization or the like.

Furthermore, as binder resin used for the above described toner, any known binder resin may be used. Examples of the binder resin include known resin such as polystyrene, a styrene-acrylic copolymer, polyester, epoxy resin, polyolefin resin such as polyethylene and polypropylene, polyamide resin, and moleic acid resin, or their modified resin. They may be used independently or in combination. In addition, examples of a coloring agent used for the above described toner include carbon black, a phthalocyanine organic pigment or dye, and a xanthene organic pigment or dye.

Additionally, in the above described toner, a charge controlling agent such as a nigrosine dye and a triphenylmethane dye, and a known fluidizing agent such as silica, titanium oxide, vinylidene fluoride, polypropylene and polyethylene can be blended as required. If 0.1 to 5% by weight of such a fluidizing agent is added to the above described toner, the amount of the accumulation of the toner in the above described charging brush is further reduced.

Furthermore, if the particle diameter of the above toner is too small, the toner is not sufficiently charged, and the cohesive power of the toner or the adhesive power to the charging brush becomes strong, so that the toner is easily accumulated in the charging brush by adhesion. On the other hand, if the particle diameter thereof is too large, the reproducibility of a thin line and a halftone becomes poor, so that high image quality is not obtained and the toner is easily accumulated in the charging brush by adhesion, in the same manner as described above. Accordingly, toner having an average volume particle diameter of 2 to 20 μm is generally used and preferably, toner having an average volume particle diameter of 3 to 8 μm is used.

Additionally, if the above described toner contains not less than 1% toner particles having a particle diameter of not less than 20 μm, an image formed becomes rough, and the amount of the accumulation of the toner in the charging brush is significantly increased. On the other hand, if the above described toner contains not less than 1% toner particles having a particle diameter of not more than 1 μm, the toner is not satisfactorily charged, so that the toner is scattered in forming an image, the image formed is, for example, fogged, and the amount of the adhesion of the toner to the charging brush is increased. Accordingly, toner including toner particles less than 1% of which have a particle diameter of not less than 20 μm and less than 1% of which have a particle diameter of not more than 1 μm is preferably used.

A second image forming apparatus according to the present invention will be described in detail.

The second image forming apparatus comprises an image carrier for carrying an electrostatic latent image on its surface, a charging brush having a brush density of 50,000 to 200,000 elements/in.$^2$ and brought into contact with the surface of the above image carrier to charge the image carrier to a predetermined polarity, latent image forming means for forming an electrostatic latent image corresponding to image information on the surface of the image carrier charged, and a developing device for developing the electrostatic latent image formed on the surface of the image carrier with toner having 0.1 to 5% by weight of a fluidizing agent whose particle diameter is 1/20 to 1/1000 of that of its toner particles added thereto.

If the toner having 0.1 to 5% by weight of the fluidizing agent whose particle diameter is 1/20 to 1/1000 of that of the toner particles added to the surface of the toner particles is used as the toner supplied to the surface of the image carrier from the developing device as described above, the fluidity of the toner is improved and the angle of repose thereof is not more than 50°, to reduce the possibility that the toner is accumulated in the charging brush by adhesion.

Meanwhile, if the particle diameter of the fluidizing agent added to the toner particles is outside of the above described range, there occur phenomena that the toner is easily accumulated in the charging brush by adhesion, the image carrier is not uniformly charged by the charging brush, and the toner accumulated in the charging blush adheres to the image carrier. If the amount of addition of the fluidizing agent is smaller than the above described range, the toner is easily accumulated in the charging brush. On the other hand, if the amount of addition thereof is larger than the above described range, the frictional charging of the toner is unstable, so that the amount of charging of the toner is not stable.

More specifically, if the particle diameter of the fluidizing agent is larger than 1/20 of that of the toner particles, the fluidizing agent does not sufficiently adhere to the surface of the toner particles. Accordingly, when the toner passes through the charging brush having a brush density of 50,000 to 200,000 elements/in.$^2$ as described above, the fluidizing agent is stripped off from the surface of the toner particles, so that the charging characteristics of the toner particles are changed, and the fluidizing agent stripped off changes the charging characteristics of the charging brush. In addition, if the particle diameter of the fluidizing agent is smaller than 1/1000 of that of the toner particles, the fluidizing agent is completely buried in the surface of the toner particles, so that the fluidity of the toner is not sufficiently improved. Accordingly, even if the amount of addition of the fluidizing agent is increased, the toner remains in a state where it is easily accumulated in the charging brush.

Furthermore, if the amount of addition of the fluidizing agent is smaller than 0.1% by weight, the fluidity of the toner cannot be sufficiently improved, so that the toner easily adheres to the charging brush. On the other hand, if the amount of addition of the fluidizing agent is larger than 5% by weight, the fluidizing agent is easily stripped off from the surface of the toner particles, so that the fluidizing agent is stripped off by the contact with the charging brush. Accordingly, the charging characteristics of the toner particles are changed. In addition, the fluidizing agent stripped off is accumulated in the charging brush, so that the charging characteristics of the charging brush is changed.

Meanwhile, in the above described toner, its toner particles are not particularly limited. Any toner generally used may be used. However, toner having an average volume particle diameter of approximately 2 to 20 μm is preferably used and more preferably, toner having an average volume particle diameter of 3 to 8 μm is used, similarly to the toner used in the above described first image forming apparatus.

On the other hand, as the fluidizing agent added to the toner particles, any known fluidizing agent having a particle diameter in the above described range can be used. Examples of the fluidizing agent include inorganic fine particles of silica, titanium oxide, and alumina, or ones obtained by subjecting the inorganic fine particles to hydrophobic treatment and resinous fine particles produced by soap-free emulsion polymerization or the like. They may be used independently or in combination.

In adding such a fluidizing agent to toner particles so that the fluidizing agent adheres to or is fixed to the surface of the toner particles, known treatment can be used. For example, the fluidizing agent and the toner particles can be mixed by a mixer such as a Henschel mixer so that the fluidizing agent adheres to the surface of the toner particles, the fluidizing agent can be fixed to the surface of the toner particles by a hybridization, an ang mill or the like, and the fluidizing agent can be fixed to the surface of the toner particles by heat.

Meanwhile, if the above described toner contains not less than 1% toner particles having a particle diameter of not less than 20 μm, an image formed becomes rough, and the amount of the accumulation of the toner in the charging brush is increased. On the other hand, if the above described toner contains not less than 1% toner particles having a particle diameter of not more than 1 μm, the toner is not satisfactorily charged, so that the toner is scattered if an image is formed, the image formed is, for example, fogged, and the amount of the adhesion of the toner to the charging brush is increased. Accordingly, toner including toner particles less than 1% of which have a particle diameter of not less than 20 μm and less than 1% of which have a particle diameter of not more than 1 μm is preferably used.

The above described third image forming apparatus according to the present invention will be described in detail.

The third image forming apparatus comprises an image carrier for carrying an electrostatic latent image on its surface, a charging brush having a brush density of 50,000 to 200,000 elements/in.$^2$ and brought into contact with the surface of the above image carrier to charge the image carrier to a predetermined polarity, and latent image forming means for forming an electrostatic latent image corresponding to image information on the surface of the image carrier charged, and a developing device for developing the electrostatic latent image formed on the surface of the image carrier with toner having an average volume particle diameter of 3 to 8 μm and including toner particles not less than 70% of which have a particle diameter in the range of $x \pm 4$ log x in the volume distribution when the average volume particle diameter is taken as $\times$ μm.

The reason why the toner having an average volume particle diameter of 3 to 8 μm is used as toner supplied to the surface of the image carrier from the developing device as described above is as follows. More specifically, if toner having an average volume particle diameter of less than 3 μm is used, the toner is not sufficiently charged and the adhesive power of the toner becomes strong, so that the toner is accumulated in the above charging brush by adhesion. Accordingly, the image carrier is not uniformly charged by the charging brush, and the image carrier is filmed with the toner accumulated in the charging brush. On the other hand, if toner having an average volume particle diameter of more than 8 μm, the reproducibility of a thin line and a halftone becomes poor, so that high image quality is not obtained, and the toner is accumulated in the charging brush by adhesion, the image carrier is not uniformly charged by the charging brush, and the image carrier is filmed with the toner accumulated in the charging brush in the same manner as described above.

Furthermore, the reason why the toner including toner particles not less than 70% of which have a particle diameter in the range of $x \pm 4$ log x in the volume distribution when the average volume particle diameter of the above described toner is taken as x μm is used is as follows. More specifically, if the amount of toner particles having a particle diameter in the range of $x \pm 4$ log x is smaller than 70% of the toner, a considerable number of toner particles having a particle diameter of less than 3 μm and toner particles having a particle diameter of more than 8 μm exist in the toner. Accordingly, if image formation is repeated, there occur the same problem as that in a case where the toner particles having a particle diameter of less than 3 μm and the toner particles having a particle diameter of more than 8 μm are used.

Furthermore, if the above described toner contains not less than 1% toner particles having a particle diameter of not less than 20 μm, an image formed becomes rough, and the amount of the accumulation of the toner in the charging brush is significantly increased. On the other hand, if the above described toner contains not less than 1% toner particles having a particle diameter of not more than 1 μm, the toner is not satisfactorily charged, so that the toner is scattered if an image is formed, the image formed is, for example, fogged, and the amount of the adhesion of the toner to the charging brush is increased. Accordingly, toner including toner particles less than 1% of which have a particle diameter of not less than 20 μm and less than 1% of which have a particle diameter of not more than 1 μm is preferably used.

Meanwhile, the toner used may be produced by any method provided that the foregoing conditions are satisfied.

Moreover, in the above described toner, a charge controlling agent such as a nigrosine dye or a triphenylmethane dye, and a known fluidizing agent such as silica, titanium oxide, vinylidene fluoride, polypropylene or polyethylene can be blended as required. If 0.1 to 5% by weight of such a fluidizing agent is added to the above toner, the amount of the accumulation of the toner in the above charging brush is further reduced.

Further, in the above described first to third image forming apparatuses, the developing device used for supplying toner to the image carrier may be of a monocomponent development type using only the above described toner or one of a two-components development type using a carrier added to the above described toner.

As the developing device used in the above described first to third image forming apparatuses, one of a monocomponent contact development type so adapted that a developer carrier such as a developing sleeve for holding toner is brought into contact with the surface of an image carrier to supply the toner to the image carrier and one of a so-called jumping type so adapted that a developer carrier and an image carrier are kept in a non-contact state, an alternating electric filed is applied therebetween, and the toner is jumped between the developer carrier and the image carrier to supply the toner to the image carrier are preferably used. In the developing devices, the toner adhering to a portion where no electrostatic latent image is formed of the image carrier is attracted to the developer carrier and is recovered in the developer carrier. Accordingly, the amount of the toner remaining on the image carrier is reduced, so that the amount of the toner accumulated in the charging brush is reduced. Consequently, if the developing devices are used, it is hardly necessary to clean the surface of the image carrier by a cleaning device.

The embodiments of the present invention will be specifically described with reference to the appended drawings, and it will be made clear that the image forming apparatuses according to the embodiments of the present invention are superior by taking comparative examples.

EMBODIMENT 1

In the embodiment, toner produced in the following is used.

In producing toner, a resin solution obtained by adding 100 parts by weight of styrene-acrylic resin, 8 parts by weight of carbon black (MA#8 manufactured by Sanyo Kasei Kogyo Co., Ltd.), and 3 parts by weight of a charge controlling agent (E-84 manufactured by Orient Kagaku Kogyo Co., Ltd.) to 663 parts by weight of a solvent composed of dichloromethane and thoroughly mixing them is added to 5% by weight of a gum arabic solution containing gum arabic as a surface-active agent, and they are agitated by an agitator (T. K homomixer manufactured by Tokusyu Kika Kogyo Co., Ltd.) at 4000 rpm for twenty minutes to prepare an emulsion dispersant. The dispersant is raised to a temperature of 50° C., and dichloromethane which is an organic solvent is evaporated in eight hours while agitating the dispersant and then, the above dispersant is filtered, particles obtained are rinsed in distilled water of 5 liters and then, the particles are dried.

The toner thus produced have an average volume particle diameter of 4 μm. In addition, as a result of measuring the shape factor SF−1 of its toner particles using an image analyzer (Ruezex 5000 manufactured by Nippon Regulator Co., Ltd.), toner particles having a shape factor SF−1 of not more than 160 are 100% of the toner. Specifically, all the toner particles have a shape factor SF−1 in the range of 100 to 120, and no toner particles have a shape factor SF−1 of not less than 170.

In the embodiments and comparative examples as shown in the following, the shape factor SF−1 of the toner particles is measured using the above described image analyzer.

Figure 3:
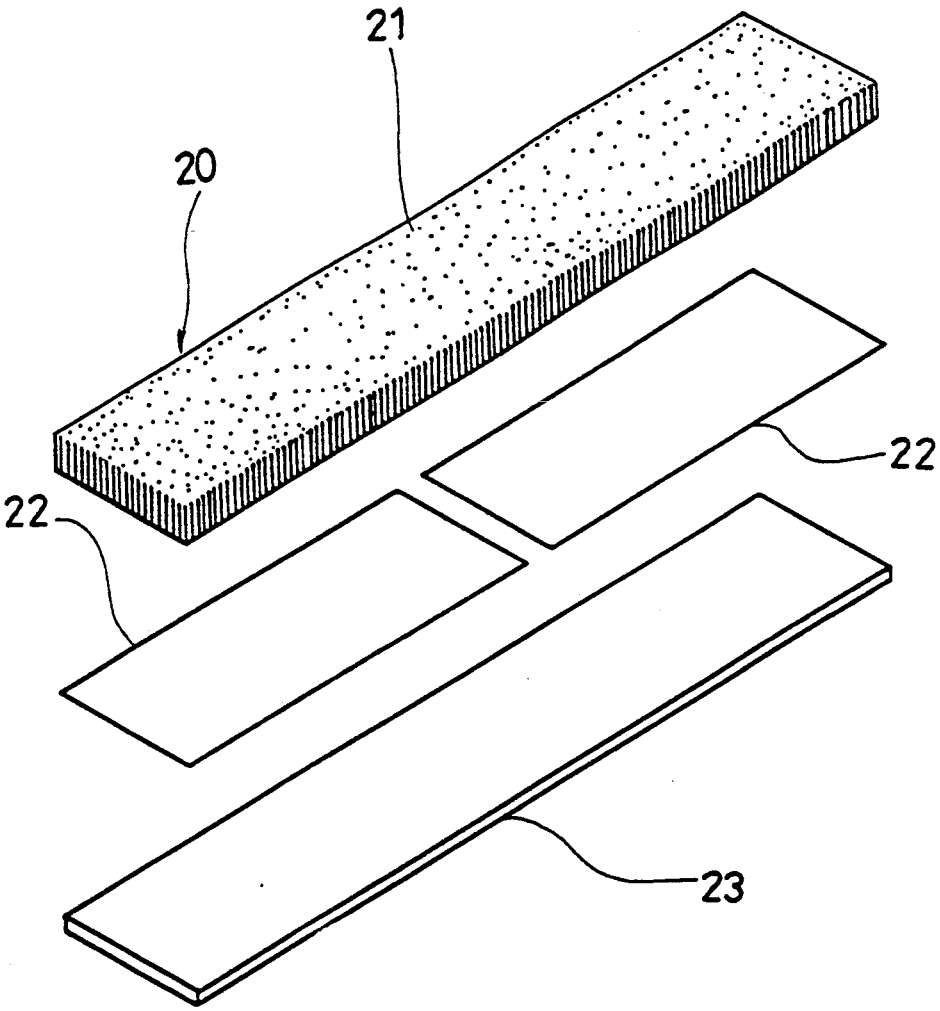
FIG. 3 is an exploded perspective view showing a charging brush used in the image forming apparatus according to the present invention.

Furthermore, as a charging brush 2 for charging an image carrier, REC B6-9 (trade name) manufactured by Toei Sangyo Co., Ltd. as shown in FIG. 3 is used. In this charging brush 2, a brush portion 21 is constituted by fibers made of rayon having 18% by weight of carbon black dispersed therein. In the brush portion 21, the length of the fibers is 5 mm, the thickness of the fibers is approximately 20 μm, the brush density of the fibers is 100,000 elements/in.$^2$, and the resistance value of the fibers is $10^6$ to $10^8\Omega$.cm. The brush portion 21 is attached to an aluminum plate 23 by a double-coated tape 22, and a part of the brush portion 21 is brought into contact with an aluminum plate 23 so that a voltage can be applied to the brush portion 21 through the aluminum plate 23.

EMBODIMENT 2

In the embodiment, toner produced in the following is used.

In producing toner, 100 parts by weight of fine particles of styrene-acrylic resin having a particle diameter of 5.5 μm in a monodisperse state, 8 parts by weight of carbon black (MA#8 manufactured by Sanyo Kasei Kogyo Co., Ltd.), 15 parts by weight of particles of PPMA resin having a particle diameter of 0.15 μm (MP-1451 manufactured by Soken Kagaku Co., Ltd.), and 4 parts by weight of a charge controlling agent (E-84 manufactured by Orient Kagaku Kogyo Co., Ltd.) are thoroughly mixed, and their mixed powder is treated by a hybridization system (manufactured by Nara Kikai Seisakusho Co., Ltd.) at a speed of 80 m/sec for five minutes.

The average volume particle diameter of the toner thus produced is 6 μm. In addition, toner particles having a shape factor SF−1 of not more than 160 are 96% of this toner. Specifically, 90% of all toner particles have a shape factor SF−1 in the range of 110 to 140, and no toner particles have a shape factor SF−1 of not less than 170.

Furthermore, REC B6-9 (trade name) manufactured by Toei Sangyo Co., Ltd. is used as a charging brush.

EMBODIMENT 3

In the embodiment, toner produced in the following is used.

In producing toner, 100 parts by weight of styrene-acrylic resin, 8 parts by weight of carbon black (MA#8 manufactured by Sanyo Kasei Kogyo Co., Ltd.), and 3 parts by weight of a charge controlling agent (E-84 manufactured by Orient Kagaku Kogyo Co,. Ltd.) are thoroughly mixed and then, are kneaded. A mixture obtained by the kneading is cooled and then, is ground and classified, and is further subjected to spherical treatment by a hibridization system (manufactured by Nara Kikai Seisakusho Co., Ltd.) at a speed of 90 m/sec for five minutes.

The average volume particle diameter of the toner thus produced is 5 μm. In addition, toner particles having a shape factor SF−1 of not more than 160 are 92% of this toner. Specifically, 90% of all toner particles have a shape factor SF−1 in the range of 140 to 160, and 0.6% of all the toner particles have a shape factor SF−1 of not less than 170.

Furthermore, REC B6-9 (trade name) manufactured by Toei Sangyo Co., Ltd. is used as a charging brush.

EMBODIMENT 4

In the embodiment, used as toner is one having an average volume particle diameter of 10 μm by decreasing the number of rotation of the above described agitator (T. K homomixer manufactured by Tokusyu Kika Kogyo Co., Ltd.) in the production of the toner according to the above described embodiment 1. Toner particles having a shape factor SF−1 of not more than 160 are 100% of this toner. Specifically, all toner particles have a shape factor SF−1 in the range of 100 to 120, and no toner particles have a shape factor SF−1 of not less than 170.

Furthermore, REC B6-9 (trade name) manufactured by Toei Sangyo Co., Ltd. is used as a charging brush.

EMBODIMENT 5

In the embodiment, toner produced in the following is used.

In producing toner, 60 parts by weight of styrene, 35 parts by weight of n-butyl methacrylate, 5 parts by weight of methacrylic acid, 0.5 parts by weight of 2,2'-azobis(2,4-dimethylvaleronitrile) which is a polymerization initiator, 8 parts by weight of carbon black (MA#8, manufactured by Sanyo Kasei Kogyo Co., Ltd.), and 3 parts by weight of a charge controlling agent (E-84 manufactured by Orient Kagaku Kogyo Co., Ltd.) are thoroughly mixed by a sand stirrer to prepare a polymerizable composition. The polymerizable composition is added to 3% by weight of a gum arabic solution containing gum arabic as a surface-active agent, and they are subjected to polymerization reaction at a temperature of 60° C. for six hours while being agitated at 5000 rpm by an agitator (T. K homomixer manufacture by Tokusyu Kika Kogyo Co., Ltd.) and are raised to a temperature of 80° C., followed by suspension polymerization reaction. After the reaction is terminated, a reaction system is cooled and is rinsed five or six times and then, is filtered and dried.

The average volume particle diameter of the toner thus produced is 2 μm. In addition, toner particles having a shape factor SF-1 of not more than 160 are 100% of this toner. Specifically, all toner particles have a shape factor in the range of 100 to 120, and no toner particles have a shape factor SF-1 of not less than 170.

Furthermore, REC B6-9 (trade name) manufactured by Toei Sangyo Co., Ltd. is used as a charging brush.

COMPARATIVE EXAMPLE 1

In the comparative example, used as toner is one having an average volume particle diameter of 6 μm and consisting of toner particles 90% of which have a shape factor SF−1 of not more than 160 and 3% of which have a shape factor SF−1 of not less than 170 by altering conditions for spherical treatment in the production of the toner according to the above described embodiment 3.

Furthermore, REC B6-9 (trade name) manufactured by Toei Sangyo Co., Ltd. is used as a charging brush.

COMPARATIVE EXAMPLE 2

In the comparative example, used as toner is one having an average volume particle diameter of 5 μm and consisting of toner particles 80% of which have a shape factor SF−1 of not more than 160 and 0.5% of which have a shape factor SF−1 of not less than 170 by altering conditions for spherical treatment in the production of the toner according to the above described embodiment 3.

Furthermore, REC B6-9 (trade name) manufactured by Toei Sangyo Co., Ltd. is used as a charging brush.

COMPARATIVE EXAMPLE 3

In the comparative example, toner produced in the following is used.

In producing toner, 100 parts by weight of styrene-acrylic resin, 8 parts by weight of carbon black (MA#8 manufactured by Sanyo Kasei Kogyo Co., Ltd.), 3 parts by weight of a charge controlling agent (E-84 manufactured by Orient Kagaku Kogyo Co., Ltd.) are thoroughly mixed and then, are kneaded. A mixture obtained by the kneading is cooled and then, is ground and classified.

The average volume particle diameter of the toner thus produced is 4 μm. In addition, toner particles having a shape factor SF−1 of not more than 160 are 22% of this toner, and toner particles having a shape factor SF−1 of not less than 170 are 65% thereof.

Furthermore, REC B6-9 (trade name) manufactured by Toei Sangyo Co., Ltd. is used as a charging brush.

COMPARATIVE EXAMPLE 4

In the comparative example, used as toner is one having an average volume particle diameter of 25 μm and consisting of toner particles 18% of which have a shape factor SF−1 of not more than 160 and 70% of which have a shape factor of not less than 170 by altering conditions for grinding and classification in the production of the toner according to the above described comparative example 1.

Furthermore, REC B6-9 (trade name) manufactured by Toei Sangyo Co., Ltd. is used as a charging brush.

COMPARATIVE EXAMPLE 5

In the comparative example, the same toner as that in the above described embodiment 1 is used, and a charging brush having a brush density of 40,000 elements/in.$^2$ is used.

COMPARATIVE EXAMPLE 6

In the comparative example, the same toner as that in the above described embodiment 1 is used, and a charging brush having a brush density of 240,000 elements/in.$^2$ is used.

EMBODIMENT 6

In the embodiment, toner produced in the following is used.

In producing toner, the same materials as those in the above described embodiment 3 are used in the same ratio, are thoroughly mixed and then, are kneaded. A mixture obtained by the kneading is cooled and then, is ground and classified, to produce toner particles having an average volume particle diameter of 7 μm.

0.3% by weight of silica whose particle diameter is 1/1000 of that of the toner particles is added to the toner particles, and they are treated by a Henschel mixer at 1000 rpm for one minute, to produce toner.

Furthermore, REC B6-9 (trade name) manufactured by Toei Sangyo Co., Ltd. is used as a charging brush.

EMBODIMENT 7

In the embodiment, toner produced in the following is used.

In producing toner, toner particles having an average volume particle diameter of 5 μm are produced in the same manner as the production of the toner according to the above described embodiment 5 except that the agitating speed by an agitator (T. K homomixer manufactured by (Tokusyu Kika Kogyo Co., Ltd.) is changed to 2500 rpm and the polymerization reaction time is changed to ten hours.

5.0% by weight of fluoroplastic fine particles whose particle diameter is 1/25 of that of the toner particles are added to the toner particles, and they are treated by a Henschel mixer at 1000 rpm for one minute, to produce toner.

Furthermore, REC B6-9 (trade name) manufactured by Toei Sangyo Co., Ltd. is used as a charging brush.

EMBODIMENT 8

In the embodiment, toner produced in the following is used.

In producing toner, toner particles having an average volume particle diameter of 4 μm are produced in the same manner as the production of the toner according to the above described embodiment 2 except that fine particles of styrene-acrylic resin having a particle diameter of 3.5 μm in a monodisperse state are used and the treating speed by a hybridization system is changed to 100 m/sec.

0.3% by weight of silica whose particle diameter is 1/150 of that of the toner particles is added to the toner particles, and they are treated by the hybridization system, to produce toner.

Furthermore, REC B6-9 (trade name) manufactured by Toei Sangyo Co., Ltd. is used as a charging brush.

EMBODIMENT 9

In the embodiment, toner produced in the following is used.

In producing toner, 0.5% by weight of silica whose particle diameter is 1/1000 of that of toner particles having an average volume particle diameter of 7 μm produced in the same manner as that in the above described embodiment 6 is added to the toner particles, and they are treated by a Henschel mixer at 1000 rpm for one minute, to produce toner.

Furthermore, REC B6-9 (trade name) manufactured by Toei Sangyo Co., Ltd. is used as a charging brush.

EMBODIMENT 10

In the embodiment, toner produced in the following is used.

In producing toner, toner particles having an average volume particle diameter of 10 μm is produced by altering conditions for grinding and classification in the production of the toner according to the above described embodiment 6, 0.3% by weight of silica whose particle diameter is 1/200 of that of the toner particles is added to the toner particles, and they are treated by a Henschel mixer at 1000 rpm for one minute, to produce toner.

Furthermore, REC B6-9 (trade name) manufactured by Toei Sangyo Co., Ltd. is used as a charging brush.

EMBODIMENT 11

In the embodiment, toner produced in the following is used.

In producing toner, toner having an average volume particle diameter of 2 μm is produced in the same manner as the production of the toner according to the above described embodiment 1 except that the agitating speed and the agitation time by an agitator (T. K homomixer manufactured by Tokusyu Kika Kogyo Co., Ltd.) are respectively changed to 7000 rpm and thirty minutes.

1.0% by weight of titanium dioxide whose particle diameter is 1/130 of that of the toner particles is added to the toner particles, and they are treated by a Henschel mixer at 1000 rpm for one minute, to produce toner.

Furthermore, REC B6-9 (trade name) manufactured by Toei Sangyo Co., Ltd. is used as a charging brush.

COMPARATIVE EXAMPLE 7

In the comparative example, toner produced in the following is used.

7.0% by weight of silica whose particle diameter is 1/1000 of that of toner particles having an average volume particle diameter of 7 μm produced in the same manner as that in the above described embodiment 6 is added to the toner particles, and they are treated by a Henschel mixer at 1000 rpm for one minutes, to produce toner.

Furthermore, REC B6-9 (trade name) manufactured by Toei Sangyo Co., Ltd. is used as a charging brush.

COMPARATIVE EXAMPLE 8

In the comparative example, toner produced in the following is used.

Toner particles having an average volume particle diameter of 8 μm are produced by altering conditions for grinding and classification in the production of the toner particles according to the above described embodiment 6, 10% by weight of fluoroplastic fine particles whose particle diameter is 1/10 of that of the toner particles are added to the toner particles, and they are treated by a Henschel mixer at 1000 rpm for one minute, to produce toner.

Furthermore, REC B6-9 (trade name) manufactured by Toei Sangyo Co., Ltd. is used as a charging brush.

COMPARATIVE EXAMPLE 9

In the comparative example, toner produced in the following is used.

Toner particles having an average volume particle diameter of 25 μm are produced by altering conditions for grinding and classification in the production of the toner particles according to the above described embodiment 6, 10% by weight of fluoroplastic fine particles whose particle diameter is ⅛ of that of the toner particles is added to the toner particles, and they are treated by a Henschel mixer at 1000 rpm for one minute, to produce toner.

Furthermore, REC B6-9 (trade name) manufactured by Toei Sangyo Co., Ltd. is used as a charging brush.

COMPARATIVE EXAMPLE 10

In the comparative example, the same toner as that in the above described embodiment 6 is used, and a charging brush having a brush density of 40,000 elements/in.$^2$ is used.

COMPARATIVE EXAMPLE 11

In the comparative example, the same toner as that in the above described embodiment 6 is used, and a charging brush having a brush density of 240,000 elements/in.$^2$ is used.

EMBODIMENT 12

In the embodiment, toner produced in the following is used.

Toner is produced in the same manner as the production of the toner according to the above described embodiment 5 except that the agitating speed by an agitator (T. K homomixer manufactured by Tokusyu Kika Kogyo Co., Ltd.) is changed to 3000 rpm and classification is carried out after the agitation.

The toner thus produced have an average volume particle diameter of 4 μm. In addition, toner particles having a particle diameter of not less than 20 μm are 0% of this toner, and toner particles having a particle diameter of not more than 1 μm are 0.4% thereof. Toner particles having a particle diameter in the range of 4±4 log 4 in the volume distribution are 78% of the toner.

Furthermore, REC B6-9 (trade name) manufactured by Toei Sangyo Co., Ltd. is used as a charging brush.

EMBODIMENT 13

In the embodiment, toner produced in the following is used.

Toner is produced in the same manner as the production of the toner according to the above described embodiment 2 except that fine particles of styrene-acrylic resin having a particle diameter of 6.5 μm in a monodisperse state are used.

The toner thus produced has an average volume particle diameter of 7 μm. In addition, toner particles having a particle diameter of not less than 20 μm are 0% of the toner, and toner particles having a particle diameter of not more than 1 μm are 0% thereof. Toner particles having a particle diameter in the range of 7±4 log 7 in the volume distribution are 90% of this toner.

Furthermore, REC B6-9 (trade name) manufactured by Toei Sangyo Co., Ltd. is used as a charging brush.

EMBODIMENT 14

In the embodiment, toner produced in the following is used.

Toner is produced in the same manner as the production of the toner according to the above described embodiment 1 except that the agitating speed and the agitation time by an agitator (T. K homomixer manufactured by Tokusyu Kika Kogyo Co., Ltd.) are respectively changed to 3000 rpm and thirty minutes and classification is carried out after the agitation.

The toner thus produced has an average volume particle diameter of 6 μm. In addition, toner particles having a particle diameter of not less than 20 μm are 0.3% of the toner, and toner particles having a particle diameter of not more than 1 μm are 2.2% thereof. Toner particles having a particle diameter in the range of 6±4 log 4 in the volume distribution are 79% of this toner.

Furthermore, REC B6-9 (trade name) manufactured by Toei Sangyo Co., Ltd. is used as a charging brush.

EMBODIMENT 15

In the embodiment, toner produced in the following is used.

100 parts by weight of polyester resin, 8 parts by weight of carbon black (MA#8 manufactured by Sanyo Kasei Kogyo Co., Ltd.), and 3 parts by weight of a charge controlling agent (E-84 manufactured by Orient Kagaku Kogyo Co., Ltd.) are thoroughly mixed and then, are kneaded. A mixture obtained by the kneading is cooled and then, is ground, and is classified three times, to produce toner having an average volume particle diameter of 8 μm.

In the toner thus produced, toner particles having a particle diameter of not less than 20 μm are 1.7%, and toner particles having a particle diameter of not more than 1 μm are 0.2%. Toner particles having a particle diameter in the range of 8±4 log 8 in the volume distribution are 73% of this toner.

Furthermore, REC B6-9 (trade name) manufactured by Toei Sangyo Co., Ltd. is used as a charging brush.

COMPARATIVE EXAMPLE 12

In the comparative example, toner produced in the same manner as the production of the toner according to the above described comparative example 3 except that conditions for classification are altered.

The toner thus produced have an average particle diameter of 15 μm. In addition, toner particles having a particle diameter of not less than 20 μm are 1.8% of the toner, and toner particles having a particle diameter of not more than 1 μm are 0% thereof. Toner particles having a particle diameter in the range of 10±4 log 10 in the volume distribution are 50% of this toner.

Furthermore, REC B6-9 (trade name) manufactured by Toei Sangyo Co., Ltd. is used as a charging brush.

COMPARATIVE EXAMPLE 13

In the comparative example, the same toner as that in the above described embodiment 12 is used, and a charging brush having a brush density of 40,000 elements/in.$^2$ is used.

COMPARATIVE EXAMPLE 14

In the comparative example, the same toner as that in the above described embodiment 12 is used, and a charging brush having a brush density of 240,000 elements/in.$^2$ is used.

One example of an image forming apparatus using the toner and the charging brush shown in each of the above described embodiments 1 to 15 and comparative examples 1 to 14 will be described with reference to FIG. 1.

In the image forming apparatus, transfer paper (not shown) contained in a paper feeding cassette 7 is sent out from the paper feeding cassette 7 by a roller 71, and the transfer paper thus sent out is introduced into a space between a cylindrical photosensitive member 1 which is an image carrier 1 and a transferring corona discharger 6 by rollers 72 and 73.

On the other hand, the above described photosensitive member 1 is rotated in a direction indicated by an arrow in FIG. 1 such that the moving speed tangential thereto is 3.5 cm/sec, and a brush portion 21 of a charging brush 2 is brought into contact with the surface of the photosensitive member 1, to charge the photosensitive member 1 by the charging brush 2.

In bringing the charging brush 2 into contact with the surface of the photosensitive member 1 to charge the photosensitive member 1, the brush portion 21 of the charging brush 2 is brought into contact with the surface of the photosensitive member 1 such that the width on the side of a short side of the charging brush 2 is 10 mm and the short side is directed toward the direction of movement of the photosensitive member 1, the brush portion 21 is pressed against the surface of the above photosensitive member 1 such that the length of contact is 1.0 mm, and a DC voltage of −1.1 kV is applied to the brush portion 21 of the charging brush 2 from a power supply (not shown) through the above described aluminum plate 23, to charge the photosensitive member 1 by the charging brush 2 such that the surface potential of the photosensitive member 1 becomes −600 V.

In forming an electrostatic latent image on the surface of the photosensitive member 1 charged in the above described manner by latent image forming means 3, an exposure device 3 using as a light source a semiconductor laser which is generally used as the latent image forming means 3 is used, and laser light is irradiated to the surface of the above described charged photosensitive member 1 from the exposure device 3 on the basis of image information, to form an electrostatic latent image on the surface of the photosensitive member 1. On the surface of the photosensitive member 1 to which the laser light is irradiated, an output of the laser light is so adjusted that the surface potential of the photosensitive member is lowered to approximately −50 V.

Then, toner 5 is supplied to the photosensitive member 1 having the electrostatic latent image formed thereon from a developing device 4, to form a toner image corresponding to the electrostatic latent image on the surface of the photosensitive member 1.

In the above described developing device 4, the toner 5 is contained in a toner containing bath 41, and an agitator 42 provided in the toner containing bath 41 is rotated, to agitate the toner 5 as well as to feed the toner 5 into a toner supply portion 43 located on the side of the above photosensitive member 1. The toner 5 fed into the toner supply portion 43 is supplied to a sleeve-shaped developer carrier 46 provided so as to cover the outer periphery of a driving roller 45 by a feed roller 44.

Furthermore, in providing the developer carrier 46 so as to cover the outer periphery of the driving roller 45 as described above in the developing device 4, used as this developer carrier 46 is a thin and flexible developer carrier formed in a sleeve shape having a diameter slightly larger than the outer diameter of the driving roller 45.

The flexible developer carrier 46 thus formed in a sleeve shape is disposed so as to cover the outer periphery of the driving roller 45, and the developer carrier 46 is brought into contact with the outer peripheral surface of the driving roller 45 by pressure in a potion other than a developing region where the developer carrier 46 is opposed to the above described photosensitive member 1 so that the developer carrier 46 is rotated as the driving roller 45 is rotated. On the other hand, in the developing region where the developer carrier 46 is opposed to the photosensitive member 1, the developer carrier 46 is projected toward the photosensitive member 1 from the driving roller 45, and a slack portion of the developer carrier 46 thus projected is brought into soft contact with the surface of the photosensitive member 1.

The above described driving roller 45 is rotated in the opposite direction to the direction of rotation of the photosensitive member 1, and the developer carrier 46 supplied with the toner 5 as described above is rotated as the driving roller 45 is rotated, to convey the toner 5 supplied to the developer carrier 46 toward the photosensitive member 1, and a regulating blade 47 is brought into contact with the surface of the developer carrier 46 by pressure during the conveyance to charge the toner 5 supplied to the surface of the developer carrier 46 by triboelectric charging as well as to regulate the the amount of the toner 5 conveyed by the developer carrier 46. In the developing device 4, the pressure of the above regulating blade 47 is so adjusted that the toner 5 is charged to approximately 20 $\mu$C/g and the amount of the toner 5 in the developer carrier 46 is approximately 0.6 mg/cm$^2$ after the regulation.

After the toner 5 thus supplied to the surface of the developer carrier 46 is charged by triboelectric charging and the amount thereof is regulated, the toner 5 charged is introduced into the developing region where the developer carrier 46 is opposed to the photosensitive member 1 by the developer carrier 46, and the slack portion of the developer carrier 46 is brought into soft contact with the surface of the photosensitive member 1 as described above in the developing region, to supply the charged toner 5 to the surface of the photosensitive member 1 from the developer carrier 46.

Meanwhile, in supplying the toner 5 to the surface of the photosensitive member 1 from the developer carrier 46, a bias voltage of −250 V is applied to the developer carrier 46 from a power supply (not shown) to carry out reversal development, and the toner 5 is supplied to a portion where an electrostatic latent image is formed of the photosensitive member 1 whose surface potential is lowered to −50 V by the irradiation of the laser light as described above, to form a toner image corresponding to the electrostatic latent image on the surface of the photosensitive member 1.

Thereafter, the photosensitive member 1 having the toner image formed on the surface thereof as described above is rotated, the toner image formed on the surface of the photosensitive member 1 is transferred to the transfer paper by the transferring corona discharger 6, the transfer paper having the toner image transferred thereto is introduced into a fixing roller 8, and the toner image is fixed to the transfer paper by heat or pressure using the fixing roller 8.

After the toner image is thus fixed to the transfer paper, the transfer paper is discharged to a discharge portion 82 by a discharge roller 81.

On the other hand, after the toner image is transferred to the transfer paper as described above, the photosensitive member 1 prepares for the next image forming processing by removing the toner 5 remaining on the surface of the photosensitive member 1 from the surface of the photosensitive member 1 by a cleaning device 9.

In the cleaning device 9, a cleaning blade 91 made of an elastic member is pressed against the photosensitive member 1 by a spring 92, and an end of the cleaning blade 91 is brought into contact with the surface of the photosensitive member 1 by pressure, to remove the toner 5 remaining on the surface of the photosensitive member 1 by the cleaning blade 91.

Then, in the above described image forming apparatus, a test is made to determine plate wear using the toner and the charging brush shown in each of the above described embodiments 1 to 15 and the comparative examples 1 to 14. In this test, A4 paper is held vertically so that an image whose black portion is 5% of the paper is formed, to examine an effect exerted on the image by the adhesion of the toner to the changing brush.

As a result, when the toner and the charging brush shown in each of the embodiments 1 to 3, 6 to 9, 12 and 13are used, there is no possibility that the toner is accumulated in the charging brush to affect the image at the time point where the test is carried out with respect to 10,000 paper sheets, thereby to make it possible to stably form a good image. In addition, when the toner and the charging brush shown in the embodiments 4, 5, 10, 11, 14 and 15 are used, there is no possibility that the toner is accumulated in the charging brush to affect the image at the time point where the test is carried out with respect to 5000 paper sheets, thereby to make it possible to stably form a good image, while the accumulation or the adhesion of a small amount of toner is observed in the charging brush at the time point where the test is carried out with respect to 10,000 paper sheets.

On the other hand, the toner is accumulated in the charging brush at the time point where the test is carried out with respect to 5000 paper sheets when the toner and the charting brush shown in each of the comparative examples 1, 2 and 7 are used, at the time point where the test is carried out with respect to 3000 paper sheets when the toner and the charging brush shown in each of the comparative examples 3 and 8 are used, and at the time point where the test is carried out with respect to 2000 paper sheets when the toner and the charging brush shown in each of the comparative examples 4, 9 and 12 are used, so that the image formed is adversely affected. For example, a white portion of the image becomes dirty. Consequently, a good image cannot be stably formed.

Furthermore, when the toner and the charging brush shown in each of the comparative examples 5, 10 and 13 are used, an inferior image due to the nonuniformity of charging is observed from the beginning of image formation. In addition, when the toner and the charging brush shown in each of the comparative examples 6, 11 and 14 are used, the toner is accumulated in the charging brush at the time point where the test is carried out with respect to 3000 paper sheets, resulting in an inferior image.

Figure 2:
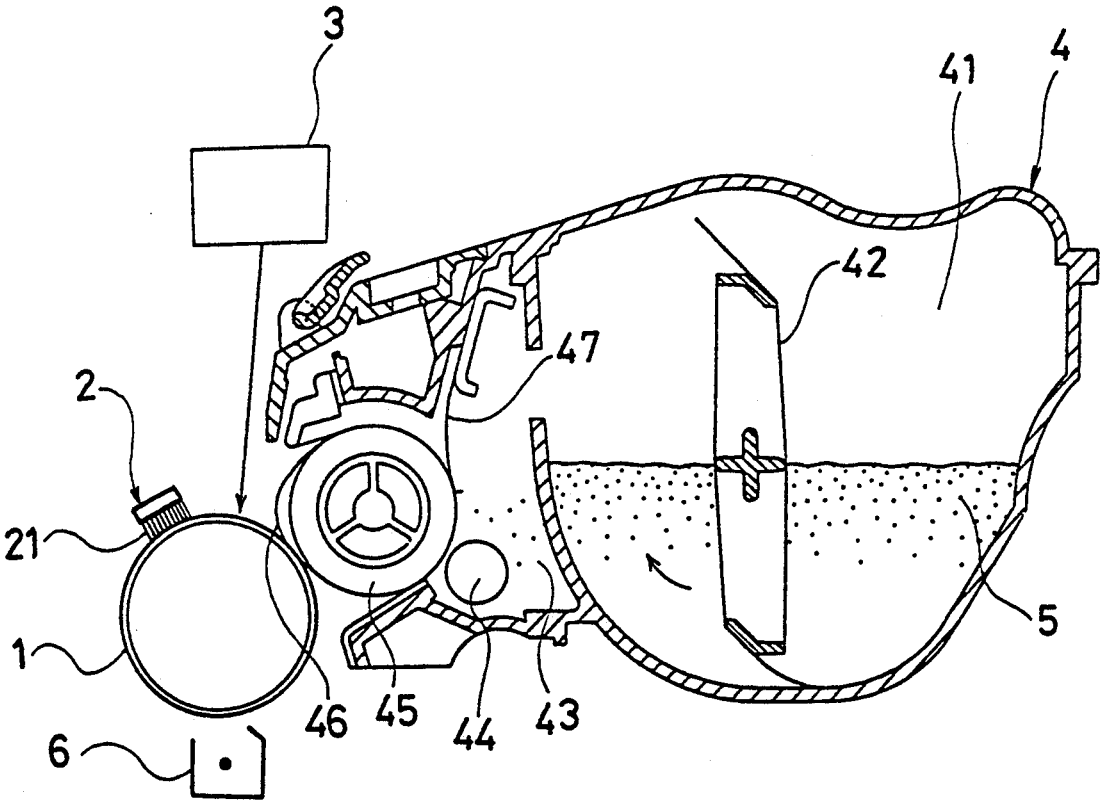
FIG. 2 is a schematic cross sectional view showing another example of an image forming apparatus according to the present invention, in which there is provided no cleaning device.

Additionally, when the toner and the charging brush shown in each of the above described embodiments 1 to 15 are used, even if the above described cleaning device 9 for removing the toner 5 remaining on the surface of the photosensitive member 1 is not provided as shown in FIG. 2, the unnecessary toner 5 adhering on the surface of the photosensitive member 1 is electrostatically attracted to the developer carrier 45 and is recovered in the developer carrier 5. Accordingly, even if the toner 5 adhering on the surface of the photosensitive member 1 after the transfer is not removed by the cleaning device 9 as in the image forming apparatus shown in FIG. 1, the possibility that the toner 5 is accumulated in the charging brush 2 by adhesion is reduced, thereby to make it possible to stably form a good image.

Meanwhile, in recovering the unnecessary toner 5 adhering on the surface of the photosensitive member 1 in the developer carrier 46 as described above, it is preferable that the nip width of the surface of the photosensitive member 1 and the slack portion of the developer carrier 46 which is brought into contact therewith is large to some extent. In the embodiments, it is preferable that the nip width is not less than 2 mm.

Figure 4:
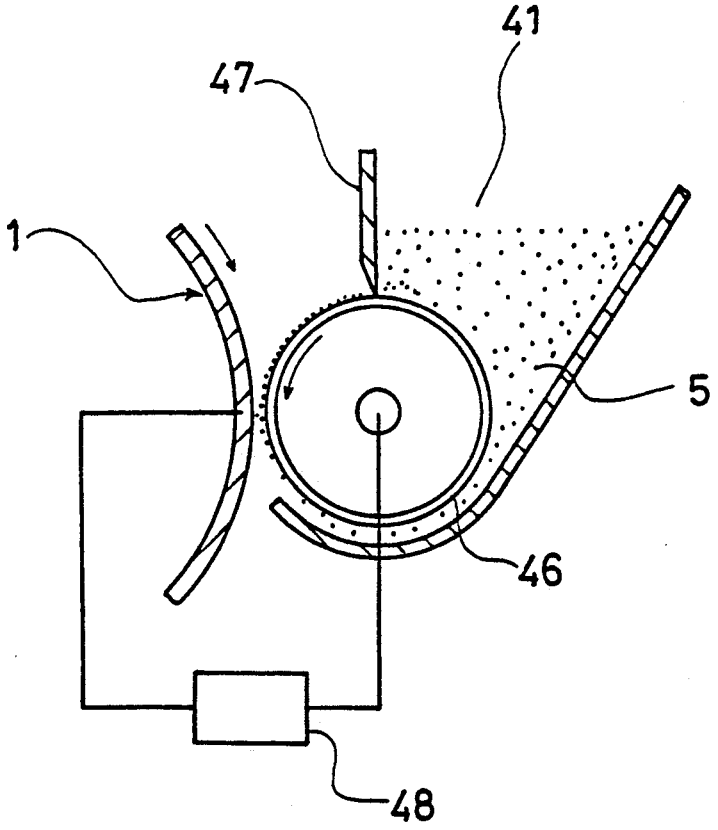
FIG. 4 is a schematic cross sectional view showing a developing device used in the image forming apparatus according to the present invention.

Then, in an image forming apparatus using a developing device as shown in FIG. 4, the same test as that in the foregoing is carried out using the toner and the charging brush shown in each of the above described embodiments 5, 11 and 13.

Also in this image forming apparatus, a charging brush 2 is brought into contact with the surface of a photosensitive member 1 to charge the photosensitive member 1, and the surface of the photosensitive member 1 thus charged is exposed to light based on image information from an optical system 3 using a semiconductor laser, to form an electrostatic latent image on the surface of the photosensitive member 1.

In supplying toner 5 to the surface of the photosensitive member 1 having the electrostatic latent image thus formed thereon to develop the electrostatic latent image formed on the surface of the photosensitive member 1 into a toner image, the developing device 4 shown in FIG. 4 is used.

In the developing device 4, the toner 5 contained in a toner containing bath 41 is supplied to a cylindrical developer carrier 46 provided so as to be opposed to the photosensitive member 1. The developer carrier 46 is provided so as to be opposed to the photosensitive member 1 such that the spacing in a portion where the developer carrier 46 and the photosensitive member 1 are in closest proximity to each other is 200 μm.

The developer carrier 46 supplied with the toner 5 as described above is rotated in the opposite direction to the photosensitive member 1, to convey the toner 5 supplied to the developer carrier 46 to the photosensitive member 1, and the amount of the toner 5 conveyed by the developer carrier 46 is regulated by a regulating blade 47 during the conveyance, and the toner 5 supplied to the surface of the developer carrier 46 is charged by triboelectric charging. In the developing device 4, the pressure of the above regulating blade 47 is so adjusted that the thickness of the layer of the toner 5 supplied to the developer carrier 46 is approximately 70 μm.

After the toner 5 thus charged by triboelectric charging is introduced into a portion which is opposed to the photosensitive member 1 by the developer carrier 46, a voltage obtained by superimposing an AC voltage of 400 V (800 Vp-p) and a DC voltage of 200 V is applied between the above developer carrier 46 and the above photosensitive member 1 from a power supply 48 to jump the toner 5 charged as described above between the developer carrier 46 and the photosensitive member 1 so that a toner image is formed in a portion where an electrostatic latent image is formed of the photosensitive member 1.

Thereafter, the toner image formed on the surface of the photosensitive member 1 is transferred to transfer paper by a transferring corona discharger 6, the transfer paper having the toner image thus transferred thereto is introduced into a fixing roller 8, and the toner image transferred is fixed to the transfer paper by heat or pressure using the fixing roller 8, while the toner 5 remaining on the surface of the photosensitive member 1 after the transfer is removed by a cleaning device 9, in the same manner as that in the image forming apparatus shown in FIG. 1.

As a result, when the toner and the charging brush shown in each of the embodiments 5 and 11 are used, there is no possibility that the toner is accumulated in the charging brush to affect the image even at the time point where the test is carried out with respect to 5000 paper sheets, thereby to make it possible to stably form a good image. In addition, when the toner and the charging brush shown in the embodiment 13 are used, there is no possibility that the toner is accumulated in the charging brush to affect the image at the time point where the test is carried out with respect to 10,000 paper sheets, thereby to make it possible to stably form a good image.

Furthermore, in the image forming apparatus using the developing device 4 shown in FIG. 4, even when the toner and the charging brush shown in each of the above described embodiments 5, 11 and 13 are used, the toner adhering on the surface of the photosensitive member 1 is electrostatically attracted to the developer carrier 46 and is recovered in the developer carrier 46. Accordingly, even if the toner adhering on the surface of the photosensitive member 1 after the transfer is not removed by the cleaning device 9, the possibility that the toner 5 is accumulated in the charging brush 2 by adhesion is reduced, thereby to make it possible to stably form a good image.

As obvious from the results, if the image carrier is charged to a predetermined polarity by bringing the charging brush having a brush density of 50,000 to 200,000 elements/in.$^2$ into contact with the surface of the image carrier, the electrostatic latent image corresponding to the image information is formed on the surface of the image carrier thus charged by the latent image forming means and then, the above described particular toner is supplied from the developing device to develop the electrostatic latent image formed on the surface of the image carrier into a toner image as in the image forming apparatus according to the present invention, the toner remaining on the image carrier is not accumulated in the charging brush by adhesion even when image formation is repeated many times, thereby to eliminate the possibilities that the image carrier is not uniformly charged and the image carrier is filmed with the toner accumulated in the charging brush by adhesion.

As a result, in the image forming apparatus according to the present invention, even when the charging brush is brought into contact with the surface of the image carrier to charge the image carrier, a good image can be stably formed.

Furthermore, in the image forming apparatus according to the present invention, the possibility that the toner remaining on the image carrier is accumulated in the charging brush by adhesion as described above is reduced, so that it is hardly necessary to provide the cleaning device for removing the toner remaining on the image carrier, thereby to make it possible to miniaturize the apparatus.

Figure 5:
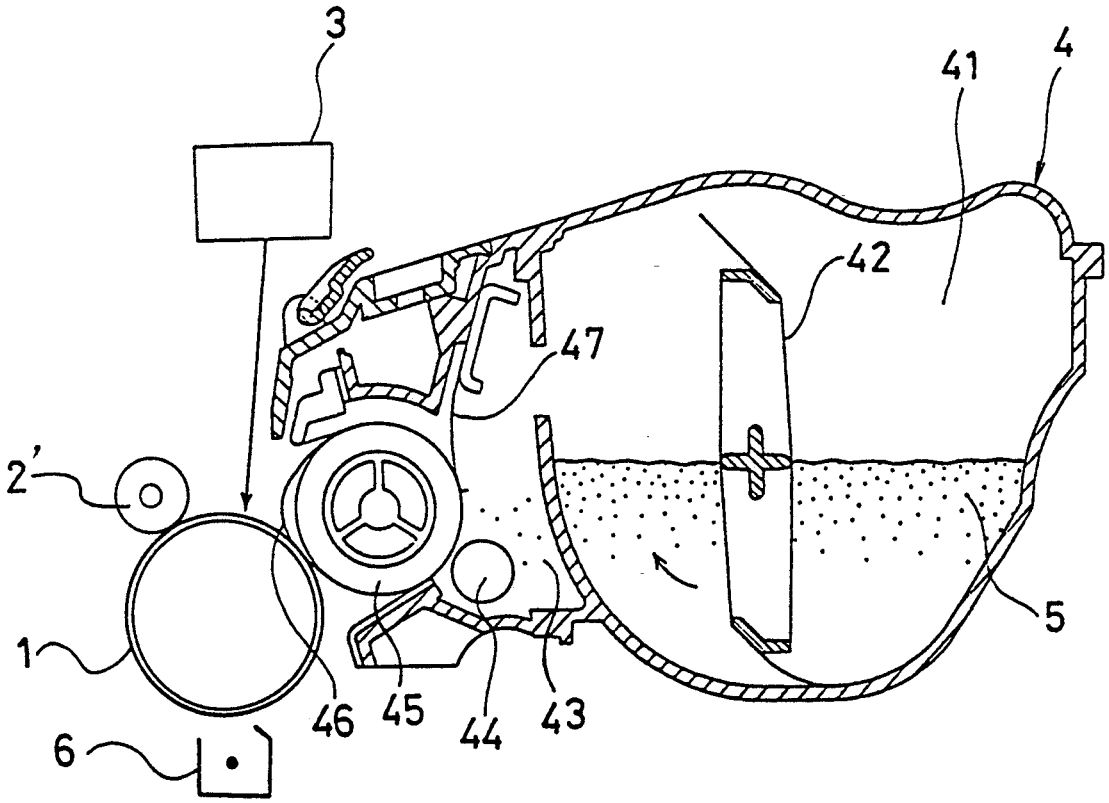
FIG. 5 is a schematic cross-sectional view of an alternate embodiment of an image forming device, in which a charging roller is employed.

FIG. 5 is a schematic cross-sectional view showing another example of an image forming apparatus according to the present invention, in which a roller is used as the charging member. The image forming apparatus shown in FIG. 5 is the same as that shown in FIG. 2, except that a charging roller 2' is brought into contact with the surface of the image carrier 1, and the image carrier 1 is charged by the charging roller 2'.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

an image carrier for carrying an electrostatic latent image on its surface, said image carrier being moved at a speed of 5 to 60 mm/sec relative to a charging brush that is pressed into contact with the surface of the image carrier to charge the image carrier to a predetermined polarity, said charging brush having a width of contact with the image carrier of 2 to 20 mm in the direction of movement of the image carrier and containing a plurality of fibers with a density of 50,000 to 200,000 fibers/in$^2$ and a length of contact with the image carrier of 0.2 to 5 mm;

latent image forming means for forming an electrostatic latent image corresponding to image information on the surface of the charged image carrier; and a developing device containing toner including toner particles not less than 90% of which have a shape factor SF−1 of not more than 160 and less than 1% of which have a shape factor SF−1 of not less than 170 so as to develop the electrostatic latent image formed on the surface of the image carrier into a toner image, wherein the shape factor SF−1 is defined as follows:

$$SF-1=(L^2/S)\times\pi/4\times100$$

where S is the area indicating the average value of the projected areas of the toner, and L is the average value of the maximum lengths in a projected image of the toner.

2. The image forming apparatus according to claim 1, wherein the thickness of the fibers of said charging brush is 1 to 20 deniers, the length of the fibers thereof is 1 to 10 mm, and the resistance value of the fibers thereof is $10^2$ to $10^9\Omega\bullet$ cm.

3. The image forming apparatus according to claim 1, wherein the average volume particle diameter of said toner is 2 to 20 μm.

4. The image forming apparatus according to claim 3, wherein said toner consists of toner particles less than 1% of which have a particle diameter of not less than 20 μm and less than 1% of which have a particle diameter of not more than 1 μm.

5. The image forming apparatus according to claim 1, wherein said developing device is of a contact development type for carrying out development by bringing a developer supplied to a developer carrier into contact with an image carrier.

6. The image forming apparatus according to claim 5, wherein there is provided no cleaning device for removing toner remaining on the image carrier after a toner image is transferred to a transfer material.

7. The image forming apparatus according to claim 1, wherein said developing device is of a jumping type for carrying out development by keeping a developer carrier and an image carrier in a non-contact state and applying an alternating electric field therebetween to cause toner to jump from the developer carrier to the image carrier.

8. The image forming apparatus according to claim 7, wherein there is provided no cleaning device for removing toner remaining on the image carrier after a toner image is transferred to a transfer material.

9. The image forming apparatus according to claim 1, wherein there is provided a cleaning device for removing toner remaining on the image carrier after the oner image is transferred to a transfer material.

10. An image forming apparatus comprising:

an image carrier for carrying an electrostatic latent image on its surface, said image carrier being moved at a speed of 5 to 60 mm/sec relative to a charging brush that is in contact with the surface of the image carrier to charge the image carrier to a predetermined polarity, said charging brush having a width of contact with the image carrier of 2 to 20 mm in the direction of movement of the image carrier and containing a plurality of fibers with a density of 50,000 to 200,000 fibers/in$^2$ and a length of contact with the image carrier of 0.2 to 5 mm;

latent image forming means for forming an electrostatic latent image corresponding to image information on the surface of the charged image carrier; and a developing device for developing the electrostatic latent image formed on the surface of the image carrier with toner having 0.1 to 5% by weight of a fluidizing agent whose particle diameter is 1/20 to 1/1000 of that of toner particles added thereto.

11. The image forming apparatus according to claim 10, wherein the thickness of the fibers of said charging brush is 1 to 20 deniers, the length of the fibers thereof is 1 to 10 mm, and the resistance value of the fibers thereof is $10^2$ to $10^9$ Ω•cm.

12. An image forming apparatus comprising:

an image carrier for carrying an electrostatic latent image on its surface, said image carrier being moved at a speed of 5 to 60 mm/sec relative to a charging brush that is in with the surface of the image carrier to charge the image carrier to a predetermined polarity, said charging brush having a width of contact with the image carrier of 2 to 20 mm in the direction of movement of the image carrier and containing a plurality of fibers with a density of 50,000 to 200,000 fibers/in$^2$ and a length of contact with the image carrier of 0.2 to 5 mm;

latent image forming means for forming an electrostatic latent image corresponding to image information on the surface of the charged image carrier; and a developing device for developing the electrostatic latent image formed on the surface of the image carrier with toner having an average volume particle diameter of 3 to 8 μm and consisting of toner particles not less than 70% of which have a particle diameter in the range of x±4 log x in the volume distribution when the average volume particle diameter of the toner is taken as x μm.

13. The image forming apparatus according to claim 12, wherein the thickness of the fibers of said charging brush is 1 to 20 deniers, the length of the fibers thereof is 1 to 10 mm, and the resistance value of the fibers thereof is $10^2$ to $10^9$ Ω•cm.

14. An image forming apparatus comprising:

an image carrier for carrying an electrostatic latent image on its surface;

a charging member for charging the image carrier to a predetermined polarity by contact with the surface of the image carrier;

latent image forming means for forming an electrostatic latent image corresponding to image information on the surface of the charged image carrier; and a developing device for developing the electrostatic latent image formed on the surface of the image carrier with toner having an average volume particle diameter of 3 to 8 μm, including toner particles not less than 70% of which have a particle diameter in the range of x±4 log x when the average volume particle diameter of the toner is taken as x μm.

15. The image forming apparatus according to claim 14, wherein said developing device is of a contact development type for carrying out development by bringing a developer supplied to a developer carrier into contact with an image carrier.

16. The image forming apparatus according to claim 15, wherein there is provided no cleaning device for removing toner remaining on the image carrier after a toner image is transferred to a transfer material.

17. The image forming apparatus according to claim 14, wherein said developing device is of a jumping type for carrying out development by keeping a developer carrier and an image carrier in a non-contact state and applying an alternating electric field therebetween to cause toner to jump from the developer carrier to the image carrier.

18. The image forming apparatus according to claim 17, wherein there is provided no cleaning device for removing toner remaining on the image carrier after a toner image is transferred to a transfer material.

19. The image forming apparatus according to claim 14, wherein there is provided a cleaning device for removing toner remaining on the image carrier after a toner image is transferred to a transfer material.

20. The image forming apparatus according to claim 14, wherein said charging member has a surface resistance value of $10^2$ to $10^9$ Ω•cm.

21. The image forming apparatus according to claim 20, wherein said charging member is applies a DC voltage of ±700 to 1500 V.

22. The image forming apparatus according to claim 20, wherein said charging member is a charging roller.

23. The image forming apparatus according to claim 14, wherein said charging member is a charging brush having a plurality of fibers and brush density of 50,000 to 200,000 fibers/in.$^2$.

24. The image forming apparatus according to claim 14, wherein said toner includes 0.1 to 5% by weight of a fluidizing agent whose particle diameter is 1/20 to 1/1000 of that of its toner particles mixed thereto.

* * * * *